US009567038B2

(12) United States Patent
Ramslie

(10) Patent No.: US 9,567,038 B2
(45) Date of Patent: Feb. 14, 2017

(54) APPARATUS AND A METHOD FOR TRANSPORTATION, INSTALLATION AND RETRIEVAL OF MARINE STRUCTURES

(71) Applicant: Seatower AS, Oslo (NO)

(72) Inventor: Sigurd Ramslie, Quinns Rocks (AU)

(73) Assignee: Seatower AS, Oslo (NO)

( * ) Notice: Subject to any disclaimer, the term of this patent is extended or adjusted under 35 U.S.C. 154(b) by 0 days.

(21) Appl. No.: 14/761,136

(22) PCT Filed: Jan. 15, 2014

(86) PCT No.: PCT/EP2014/050696
§ 371 (c)(1),
(2) Date: Jul. 15, 2015

(87) PCT Pub. No.: WO2014/111420
PCT Pub. Date: Jul. 24, 2014

(65) Prior Publication Data

US 2015/0344111 A1 Dec. 3, 2015

(30) Foreign Application Priority Data

Jan. 17, 2013 (GB) ..... 1301360.2

(51) Int. Cl.

| | |
|---|---|
| ***B63B 9/00*** | (2006.01) |
| ***B63B 35/42*** | (2006.01) |
| ***E02B 17/02*** | (2006.01) |
| ***E02B 17/08*** | (2006.01) |
| ***B63B 35/00*** | (2006.01) |

(Continued)

(52) U.S. Cl.
CPC ..... *B63B 9/00* (2013.01); *B63B 9/065* (2013.01); *B63B 35/003* (2013.01); *B63B 35/42* (2013.01); *E02B 17/02* (2013.01); *E02B 17/08* (2013.01); *B63B 2001/145* (2013.01); *B63B 2009/067* (2013.01); *B63C 1/02* (2013.01);

(Continued)

(58) Field of Classification Search
CPC ..... B63B 35/44; B63B 35/4413; B63B 35/42; B63B 35/00; B63B 1/00; B63B 1/10; E02B 17/02; E02B 17/08
USPC ..... 114/265; 405/205, 203, 204, 209
See application file for complete search history.

(56) References Cited

U.S. PATENT DOCUMENTS

| | | | |
|---|---|---|---|
| 3,097,495 | A | 7/1963 | LaBorde et al. |
| 5,607,260 | A | 3/1997 | Khachaturian |

FOREIGN PATENT DOCUMENTS

| | | | |
|---|---|---|---|
| DE | 10201040 | A1 | 7/2003 |
| EP | 2251254 | A1 | 11/2010 |

(Continued)

OTHER PUBLICATIONS

Martínez, Felipe, "International Search Report," prepared for PCT/EP2014/050696, as mailed Apr. 17, 2014, three pages.

*Primary Examiner* — Lars A Olson
(74) *Attorney, Agent, or Firm* — Winstead PC

(57) ABSTRACT

An apparatus (1') for transportation, installation and retrieval of marine structures (10) is disclosed and illustrated. It comprises at least two suitably connected vessels (1,2) with adjustable buoyancy, each having a first end (5) and a second end (8). The apparatus is equipped with lifting mechanism for lifting a marine structure on and from it. The vessels (1,2) are connected to each other at each said first end (5) at an angle (4) and are free at each said second end (8), thus forming a V-shape. The invention also embraces the methodology for transportation, installation and retrieval of marine structures, using the apparatus (1').

6 Claims, 6 Drawing Sheets

(51) Int. Cl.

| | |
|---|---|
| ***B63B 9/06*** | (2006.01) |
| *E02B 17/00* | (2006.01) |
| *B63C 1/02* | (2006.01) |
| *B63C 7/04* | (2006.01) |
| *B63B 1/14* | (2006.01) |

(52) U.S. Cl.
CPC ..... *B63C 7/04* (2013.01); *E02B 2017/0047* (2013.01); *E02B 2017/0052* (2013.01)

(56) References Cited

FOREIGN PATENT DOCUMENTS

| | | | |
|---|---|---|---|
| WO | WO-0078604 | A1 | 12/2000 |
| WO | WO-2012001344 | A1 | 1/2012 |

APPARATUS AND A METHOD FOR TRANSPORTATION, INSTALLATION AND RETRIEVAL OF MARINE STRUCTURES

FIELD OF THE INVENTION

The present invention in general, relates to an apparatus and method for transportation, installation and retrieval of marine structures.

Particularly, the present invention relates to a technology for installation and retrieval of marine structures, with the help of an apparatus where at least two vessels with adjustable buoyancy are connected so as to form a substantially V-shaped configuration.

More particularly, the present invention relates to an apparatus according to the preamble of claim 1 and to a method according to the preamble of claim 6.

TECHNICAL BACKGROUND OF THE INVENTION

In off-shore operations such as oil and gas explorations and productions, transportation, installation and retrieval of marine structures are very common. Such marine structures include off-shore platforms, jackets supporting such platforms, towers for bridges and windmills and other gravity based structures. It is also known that such marine structures are towed to appropriate locations by vessels, barges, hulls and other bodies having adjustable buoyancy as known to persons skilled in the art. These are effectively used for installation of marine structures. Further, such vessels/barges have been effectively used for retrieval of marine structures, once their life span is over or for shifting those structures to other sites of operation.

U.S. Pat. No. 5,607,260 discloses an apparatus and a method for installation and removal of large multi ton deck packages. It teaches the use of two barges which can support a large multi ton load. A variable dimensional truss assembly is supported by the barge and forms a load transfer interface between the barge and the deck package.

The above prior art document, like most prior art techniques uses two parallel barges, which have to be interconnected with substantially large beams. This makes the arrangement less sturdy and a bit cumbersome, for loading and removing the marine structure, on and from the deck of the vessel. That apart, the top portion of the apparatus has height restriction due to the truss assembly. Hence, height restrictions exist in respect of the structure to be towed or installed or retrieved. That apart, positioning of the barges around the structure to be carried or installed or lifted is also another problem.

International PCT publication number WO 00/78604 discloses a vessel, which is a U-shaped pontoon foundation for removal and installation of marine structures. Columns are attached to the pontoon foundation, extending upwards. A tubular rotational beam is fixed to the top of the transverse pontoon and it is engaged with a bracket attached to a side of the jacket leg to be lifted. Then lifting is done with the help of a lifting frame and de-ballasting.

The above document does teach use of a U-shaped pontoon foundation which enables convenient positioning of the vessel, around a platform being installed or a platform being removed. However, the positioning, lifting and removal is dependent on a lifting frame on the top portion of the pontoon foundation, which naturally imposes a height restriction.

Hence, there has been a need for an apparatus for transportation, installation and removal of marine structures, which has a sturdy structure, requires less length of coupling beams for connecting the units of the apparatus and has free space above of the loading zone. There has been also a need for providing a methodology for transportation, installation and retrieval of marine structures which is simple and quick.

The present invention meets the above mentioned needs and other associated needs by providing an apparatus which has at least two basic units of adjustable buoyancy, which are coupled together in a substantially V-shaped form.

OBJECTS OF THE INVENTION

It is the prime object of the present invention to provide an apparatus for transportation, installation and retrieval of marine structures, which has a sturdy structure, requires lesser length of coupling beams for connecting the units of the apparatus and has the top of the loading zone free.

It is another object of the present invention to provide a methodology for transportation, installation and retrieval of marine structures which does not involve cumbersome steps and is substantially quick.

It is a further object of the present invention to provide an apparatus for installation and retrieval of marine structures which removes or substantially reduces the requirement for hinged connections and sliding parts for connecting its two basic buoyant units.

All through the specification including the claims, the words "vessels", "marine structures", "V-shaped", "barges", "cross-beams", "coupling beams", "load", "cargo", "structure" are to be interpreted in the broadest sense of the respective terms and includes all similar items in the field known by other terms, as may be clear to persons skilled in the art. Restriction/limitation, if any, referred to in the specification, is solely by way of example and understanding the present invention. Further, it is hereby clarified that the term "riser system" should be construed in its broadest sense as applicable in subsea operations.

SUMMARY OF THE INVENTION

According to a first aspect of the present invention there is provided an apparatus for transportation, installation and retrieval of marine structures comprising at least two suitably connected vessels with adjustable buoyancy. Each of the vessels has a first end and a second end. The vessels are equipped with lifting mechanisms for lifting a marine structure on and from the apparatus. According to the invention, the vessels are connected to each other at each first end at an angle and are free at each of the second ends, thus forming a V-shape.

Preferably, the vessels are connected to each other substantially by means of cross beams at points on the deck of each vessel, in between the engaged first ends and the free second ends and so that there is room for carrying a load having a centre of gravity situated between the free second ends (8) of the vessels and the cross beam.

More preferably, the vessels are barges having a hull structure and equipped with ballast tanks for ballasting and de-ballasting the vessels evenly or at desired ends.

Most preferably, consoles are provided substantially centrally on the cross beam between the barges and at symmetrically opposite locations near the free second ends on each of the barges . The barges are arranged to lift a marine structure by winch or jacks and to lock it in position at three, four or five points on the consoles, such that the structure is secured substantially between the barges near the free second ends.

According to a second aspect of the present invention there is provided a method for transportation and installation of a marine structure by using the apparatus as described hereinbefore. The method comprises manoeuvring the vessels coupled in substantially 'V' shape into position so that the marine structure resting at its initial location is substantially placed in between the vessels close to the free second ends. Thereafter the structure is lifted and secured at a position between the vessels near the free second ends, by suitable means. Then the structure is towed to the desired location by the vessels coupled in substantially V-shape. On reaching the desired location, the structure is de-coupled from the consoles and gradually lowered to the sea bed close to the free second ends. This is done either by ballasting to desired depth or by being held by the ropes of winches present in at least three consoles on the apparatus, possibly combined with a de-ballasting the vessels for balanced operation.

Preferably, the step of lifting and securing and the structure in position for towing comprises lifting the structure by winch or jacks and locking it in position at the three, four or five points on consoles. After securing the structure to the consoles the jacks or winches may be released. Preferably the vessel is ballasted at the first ends.

Alternatively, the step in the preceding paragraph comprises ballasting the vessels to the desired depth, positioning of the structure and securing it between the vessels, de-ballasting the vessels to lift the structure so secured to the desired position, for making it ready for towing.

BRIEF DESCRIPTION OF THE DRAWINGS

Having described the main features of the invention above, a more detailed and non-limiting description of an exemplary embodiment will be given in the following with reference to the drawings.

DETAILED DESCRIPTION OF THE INVENTION

Figure 1A:
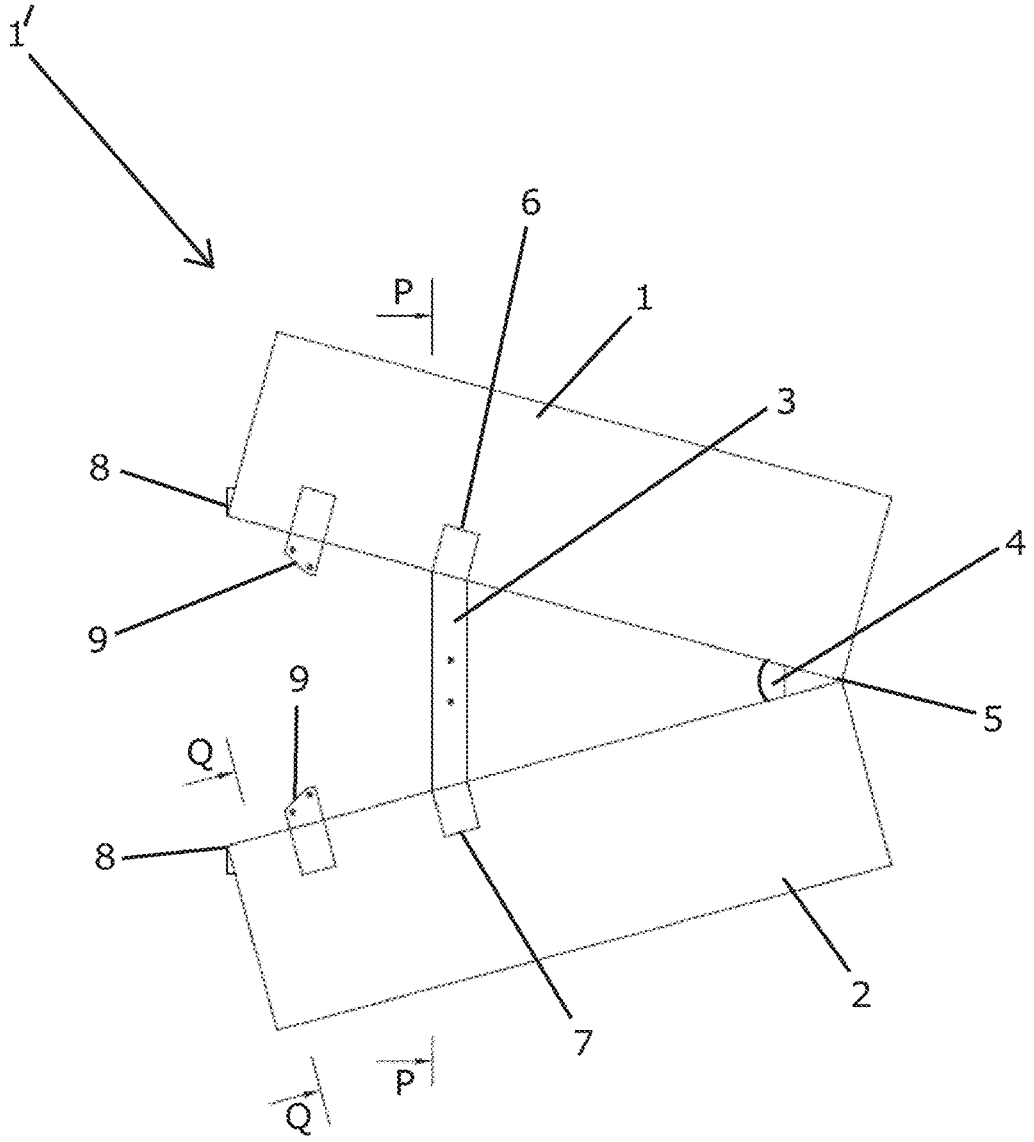
FIG. 1*a* is a plan view of the apparatus according to a preferred embodiment of the present invention.

The following describes a preferred embodiment of the present invention which is purely exemplary for the sake of understanding the invention and non-limiting.

In all the figures, like reference numerals represent like features. Further, when in the following it is referred to "top", "bottom", "upward", "downward", "above" or "below" and similar terms , this is strictly referring to an orientation with reference to the sea bed, where the sea bed is horizontal and at the bottom.

It should also be understood that the orientation of the various components may be otherwise than shown in the drawings, without deviating from the principle of the invention. Furthermore, the disposition of winches, cranes supporting platforms for the marine structures are not shown, as those are not consequential to the present invention and should be understood by persons skilled in the art.

FIG. 1*a* is a plan view of the preferred embodiment of the apparatus 1'. It comprises two barges 1, 2 with hull structure. Each of the two barges has a first end 5 and a second end 8. The first ends 5 of the barges are connected so as to form an angle 4, while the second ends 8 are free, so that the barges 1, 2 form substantially a V-shape.

The barges 1, 2 are also connected at points 6, 7 on respective decks by rigid cross beams 3, which act as a coupling element. The barges 1, 2 are equipped with ballast tanks (not shown), for ballasting and de-ballasting and for that purpose sea water may be conveniently used. Ballasting and de-ballasting may be done evenly throughout the barges 1, 2 or at selected ends. To facilitate this, the barges are conveniently divided into several ballast chambers.

The barges 1, 2 have requisite facilities like cranes and winches (not shown) etc. suitably placed on a working platform (not shown). The barges 1, 2 are selected and placed at an angle in 'V' shape, the angle depending on the size of the article to be towed, hazard en route, the location where the article is to be delivered and so on. The barges can be towed by other vessels or they may be self-propelled.

The barges support a marine structure 10, often referred to hereinafter as load/cargo 10, along respective decks and also along the portion in between the two barges 1, 2 near the free second ends 8 of each. The barges 1, 2 can tow the marine structure conveniently to the desired location.

Suitable consoles 9 are placed on the middle portion of the cross beam 3 (best shown in FIG. 2*a*) and at one or two points more, away from the points 6, 7 on the decks of the barges 1, 2 where the cross beam 3 is connected to the barges 1, 2.

The angle 4 between the barges 1, 2 and the location of the cross beam 3 is mainly decided by the size of the cargo 10 to be transported. The rigid connections are made with generously designed heavy metal brackets and coupling beams, suitable to withstand the loads under extreme conditions while transporting. Thus an arrangement is arrived at, where a pair of barges 1, 2 coupled like a pair of tongs; act as a single floating body. A strong monolithic structure is obtained free from complication of hinges, concrete poles and so on as known in the art.

Figure 1B:
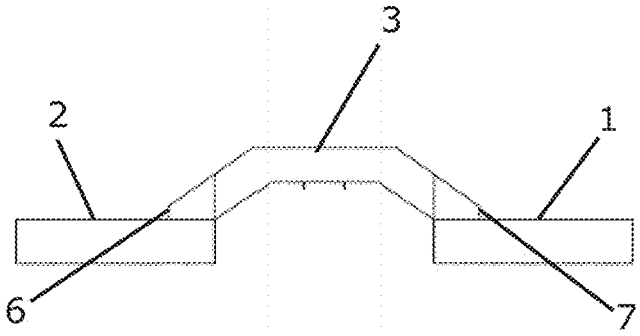
FIG. 1*b* is a cross-sectional view along the line P-P in FIG. 1*a*.
Figure 3:
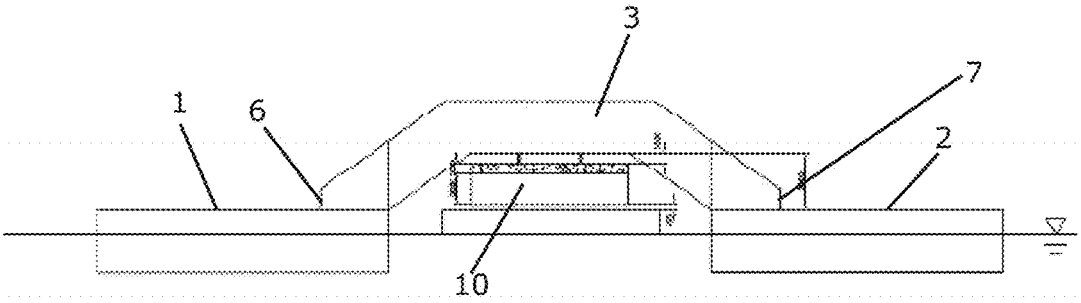
FIG. 3 is an enlarged view of the view in FIG. 1 b also showing the structure to be transported.

FIG. 1*b* is a cross-section along the line P-P in FIG. 1*a*, while FIG. 1*b* is a cross-section along the line Q-Q in FIG. 1*a*. FIG. 1*b* shows elaborately the configuration of the cross/coupling beam 3 with respect to the points 6, 7 on the decks of the barges 1, 2. FIG. 3 is an enlarged view of the view shown in FIG. 1*b* together with the load 10 to be transported.

Figure 1C:
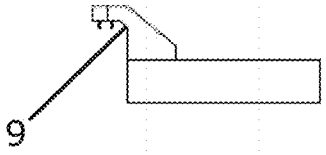
FIG. 1*c* is a cross-sectional view along the line Q-Q in FIG. 1*a*.
Figure 4:
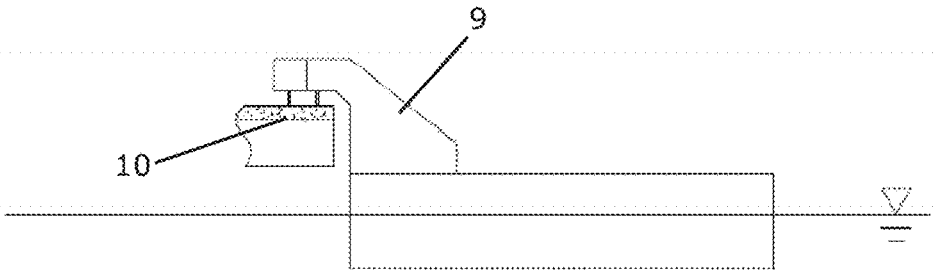
FIG. 4 is an enlarged view of the view in figure lc also showing the structure to be transported.

FIG. 1*c* shows the console 9. FIG. 4 is an enlarged view of the figure lc together with the load to be transported. This FIG. 4 also shows the lifting arrangement for the load 10.

Figure 1D:
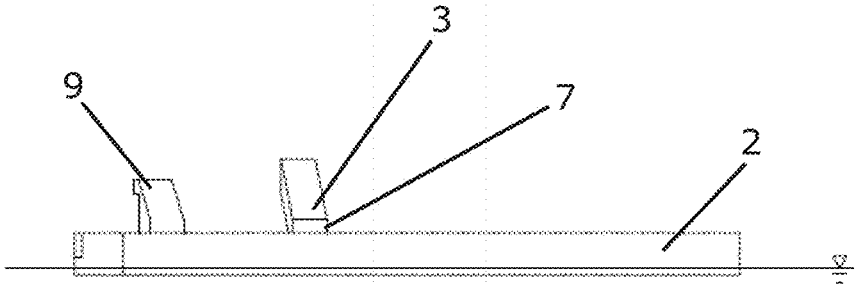
FIG. 1*d* is a side view of the apparatus shown in FIG. 1*a*.

FIG. 1*d* is a side view of the apparatus which shows the consoles 9 and the cross beam 3.

When the FIGS. 1*a*, 1*b*, 1*c* and 1*d* are seen together it would be clear that the apparatus in its simplest form does not have hinged or sliding parts. Hence, potentialities of wear and tear are reduced. Two coupling points of connection between the barges 1, 2 with a long distance in between provide good torsion stiffness for coupled barges. Further, particularly FIGS. 1*a*, 1*b* and FIG. 3 reveal the significantly reduced dimensions of the coupling beam 3 between the barges 1, 2.

Figure 2A:
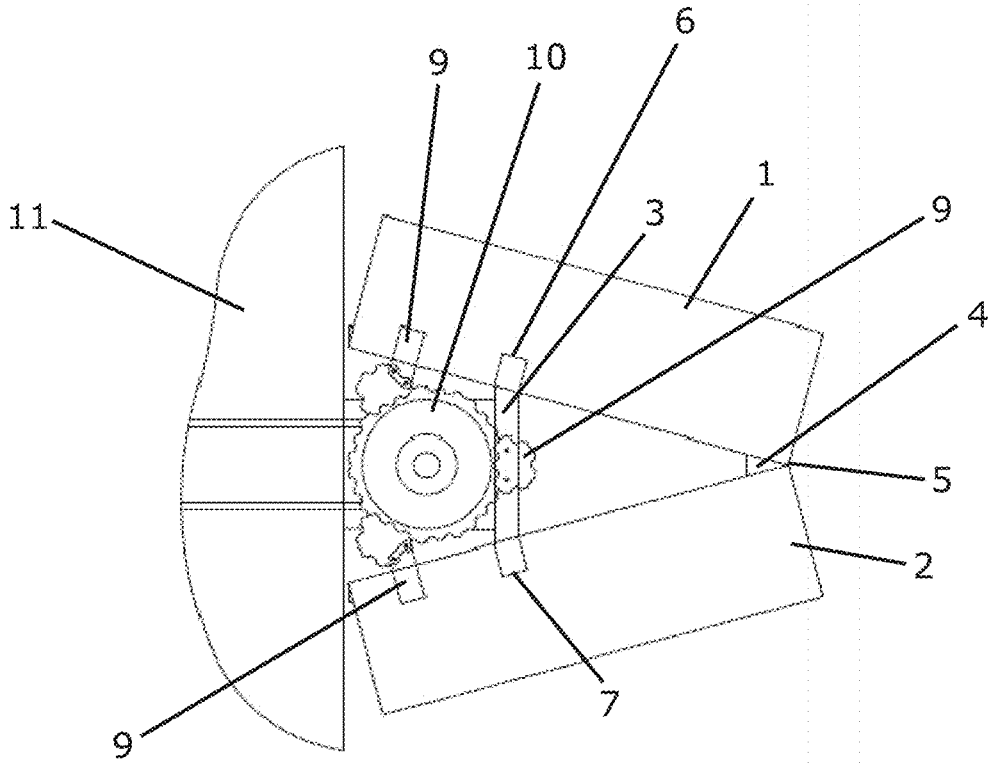
FIG. 2*a* is a plan view of the apparatus showing the coupled barges manoeuvred into position and ready to lift the load.

FIG. 2*a* is a plan view of the apparatus showing the coupled barges 1, 2 manoeuvred into position. The structure 10 to be transported is seen resting at its initial location 11, usually outside a quay or in a dry dock, where the structure has either been constructed or carried by road for onward transport to its final location at sea.

Figure 2B:
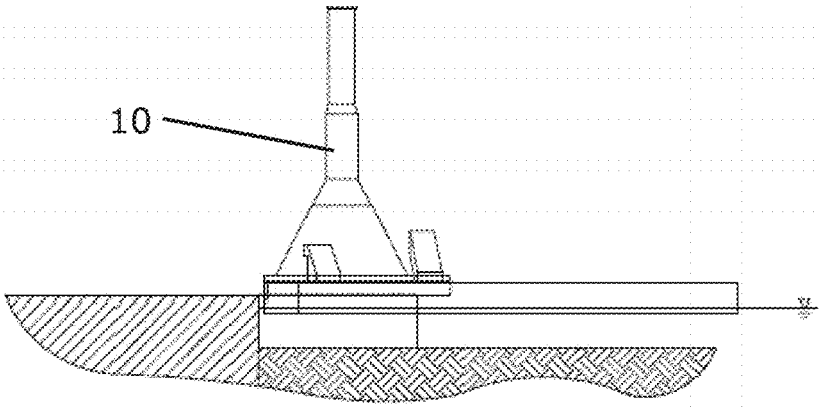
FIG. 2*b* is a side view of the apparatus shown in FIG. 2*a* before loading of the structure to be transported.
Figure 2C:
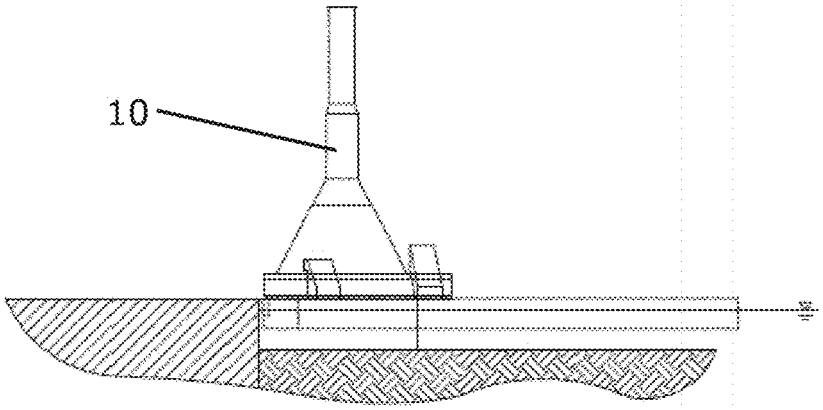
FIG. 2*c* is a side view of the apparatus shown in FIG. 2*a* after loading of the structure to be transported.

FIG. 2*b* is a side view of the apparatus in FIG. 2*a*, when the structure 10 is yet to be loaded. FIG. 2*c* is the side view when the structure 10 after the barges have been ballasted to a greater draught and ready to lift the structure.

Figure 5A:
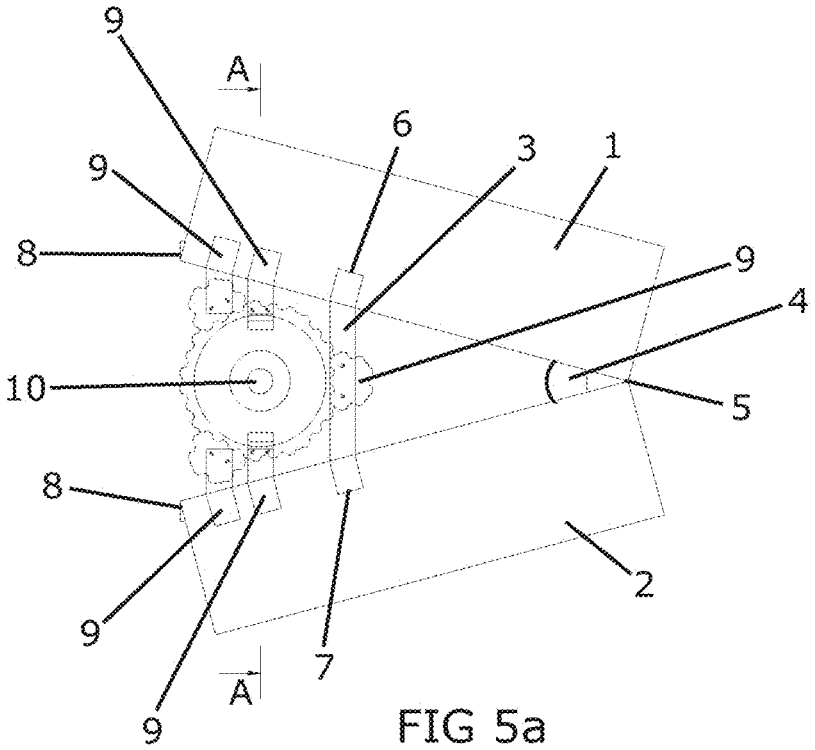
FIG. 5*a* is a plan view of the apparatus lifting a windmill foundation.
Figure 5B:
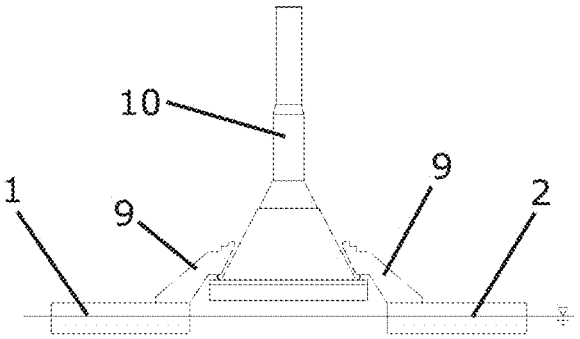
FIG. 5*b* is a cross-sectional view along the lines A-A in FIG. 5*a*.

FIGS. 5*a*, 5*c* and 5*e* are plan views of the apparatus showing lifting of GBS slabs 10 of different diameters by the apparatus. By way of example, the load here comprises GBS slabs of varying diameters. The FIGS. 5*b*, 5*d* and 5*e* are cross-sectional views along lines A-A in FIGS. 5*a*, 5*c* and 5*e* respectively. These FIGS. 5*b*, 5*d* and 5*e* in particular, unequivocally corroborate that the apparatus in accordance with the present invention can be configured to transport, install and retrieve loads of varying shape and weight. This will be explained again later.

The example chosen here shows that normally the hulls without the cargo load and with ballast compartments empty, i.e. only supporting its deck load with the beam 3 etc. will have a freeboard of more than 5.0 m and a draft of about 1.0 m. The hulls have ballast compartments distributed along its length which when filled can submerge the hulls evenly or at one side, depending on the requirement.

All the above figures are again referred to while explaining the functioning of the apparatus of the present invention.

Referring to FIG. 5*a* the elaborate functioning is described. First, the barges 1, 2 coupled in 'V' shape are manoeuvred into position so that the marine structure 10 (a foundation for a windmill in this preferred example), resting at its initial location 11, is near the free second end 8 of the coupled barges 1, 2 and between the barges 1, 2. As stated before, this may be a dry dock 11 where the structure has either been constructed or carried by road for onward transport to its final location at sea. The structure 10 is yet to be lifted and secured near the middle of the open end of the tong like formation.

At the next stage, best shown in FIG. 5*a*, the foundation is lifted by winches or jacks and locked in position at, in this case, the five points on the consoles 9 during transportation. The first point is the middle point 9 of the coupling beam 3 between the two barges 1, 2, and the other points being on symmetrically opposite consoles 9 on each of the barges 1, 2.

It would be particularly clear from FIG. 5*b* that the structure 10 is placed and secured between the barges 1, 2 near the free second ends 8 of the tong-like formation for towing along the sea surface. This ensures transportation with ease and safety. It would be understood to persons skilled in the art that this is equally true in respect of lifting the marine structure 10 from such location and installing it on the seabed through the sea water and also for retrieving a marine structure from the sea bed.

FIG. 2*c* is a side view of the apparatus when the barges have been ballasted to increase the draught. In this position the structure 10 is secured in place and made ready for towing. The view in FIG. 3 shows the stage when the structure (in this case a GBS slab) has been lifted off the surface on which it has been placed. The lifting is at least partially done by de-ballasting the barges.

Before towing commences the ballast compartments at the opposite end of the barges, i.e. towards the first end 5 of the apparatus are filled with seawater to balance the cargo load 10 and keep the hulls evenly floating. The structure 10 is now absolutely ready to be towed.

The structure 10 is towed and on reaching the scheduled location, the slab 10 is decoupled from the consoles 9 and gradually lowered to the sea bed, held by the ropes of the winches present in at least three consoles 9 for balanced operation. After proper placement of the slabs 10 on the sea bed, the winch ropes can be disengaged by any means, say by deploying an ROV and wound back, completing the operation.

Working in a reverse mode, this method and apparatus can be equally effective for retrieval of suitable marine structures from sea bed and towing those to other locations or back to a suitable location for decommission or disposal. On retrieval of the marine structure according to the present invention, it may be towed back by the apparatus of the present invention or by other vessels and this is within the scope of the present invention.

It would be clear to the person of skill that the apparatus in accordance with the present invention has the ability to lift and secure in place loads of varying dimensions. Thus, the apparatus in accordance with the present invention can be suitably configured, for its applicability on structures of varying diameters, lengths, widths, heights and shapes. To accommodate for this the angle 4, the location of the cross beam 3 and the location of the consoles 9 may need to be adjusted. To facilitate this, the cross beam 3 and the consoles 9 may be slidably arranged on the barges.

In general for a 7000 T load, ballast water needed is 6000 T, when the barge is considered completely rectangular and in the example considered the draft is 3.6 m. These aspects would be clear from FIGS. 2*a*, 2*b* and 2*c*. In FIG. 2*a*, the draft is about 1 m while in FIG. 2*c* draft is about 3.6 m.

It may be noted that loading of the loads 10 can be done by various means and that is not consequential to the present invention. For example, instead of first ballasting the barges to a greater draught, then position and attach load and then de-ballast to lift the cargo, it is also possible to lift the cargo by jacks/winches and adjust the level of the barges by ballasting during the lifting. This aspect is within the scope of the present invention.

Unlike systems taught in prior art, loading and towing cargoes of significant height is not a constraint according to the present invention. This is a huge practical benefit. Decoupling and placing of the structure 10 on the seabed is a very simple process compared to what is taught in most of the prior arts where, before the cargo can be lowered to the sea bed, elaborate arrangements are required to clear the cargo from the barges. However, owing to the open 'V' shaped construction in this invention, the cargo can be simply decoupled and lowered to sea bed.

Furthermore, significantly reduced dimensions of coupling beams between barges are achieved compared to prior art. This not only saves the material, it provides a more sturdy structure due to the shorter span of the beam.

Additionally, no hinged or sliding parts for joining the barges is required, which ensures less chances of failure and resulting maintenance requirement.

The present invention has been described with reference to a preferred embodiment and some drawings for the sake of understanding only and it should be clear to persons skilled in the art that the present invention includes all legitimate modifications within the ambit of what has been described hereinbefore and claimed in the appended claims.

The invention claimed is:

1. An apparatus for transportation, installation and retrieval of marine structures comprising:

at least two inter-connected vessels with adjustable buoyancy;

wherein each of the at least two inter-connected vessels comprises a first end and a second end and are equipped with a mechanism for lifting and carrying a marine structures;

wherein the at least two inter-connected vessels are connected to one another at each said first end at an angle and are free at each said second end forming a V-shape;

wherein the at least two inter-connected vessels are connected to one another substantially via at least one cross beam at points on a deck of each of the at least two inter-connected vessels, said points being between engaged first ends and free second ends resulting in room for carrying a load having a center of gravity situated between the free second ends of the at least two inter-connected vessels and the at least one cross beam;

wherein the at least two inter-connected vessels are barges comprising a hull structure and being equipped with ballast tanks for ballasting and de-ballasting the barges evenly or at desired ends; and wherein consoles are provided for lifting and securing the load along the at least one cross beam between the barges and at symmetrically opposite locations near the free second end of each of the barges.

2. The apparatus according to claim 1, wherein the barges are arranged to lift the marine structure by winch or jacks and to lock it in position at three, four or five points on said consoles for securing said marine structure substantially between the barges near the free second end of the barges.

3. A method for transporting and installing a marine structure by using an apparatus comprising at least two inter-connected vessels with adjustable buoyancy, such that said at least two inter-connected vessels are connected to one another at a first end so as to form an angle and are each free at a second end forming a substantially V-shape, the method comprising:

a) maneuvering the at least two inter-connected vessels coupled in substantially V-shape into position so that the marine structure resting at its initial location is placed substantially in between the at least two inter-connected vessels close to the free second ends;

b) lifting, securing and releasing the marine structure while the marine structure is at the position between the at least two inter-connected vessels near the free second ends by lifting the marine structure by winch or jacks and locking the marine structure in position at at least three points on consoles, the at least three points being provided substantially along a middle of a cross beam between the at least two inter-connected vessels and at symmetrically opposite locations near the free second end on each of the at least two inter-connected vessels and releasing the winch or jacks while ballasting the at least two inter-connected vessels near the first end;

c) towing the marine structure to a desired location by the at least two inter-connected vessels coupled in substantially V-shape; and d) on reaching the desired location, gradually lowering the marine structure to a seabed.

4. The method according to claim 3, wherein the lifting is done by ballasting the at least two inter-connected vessels to a desired depth, securing the marine structure to the at least two inter-connected vessels and subsequently de-ballasting the at least two inter-connected vessels.

5. The method according to claim 3, wherein the lifting is done by ropes of winches present in at least three consoles on the apparatus and de-ballasting the at least two inter-connected vessels for balanced operation.

6. The method according to claim 3 wherein step b) comprises ballasting the at least two inter-connected vessels to a desired depth, positioning the marine structure and securing marine structure between the at least two inter-connected vessels near the free second ends, de-ballasting the at least two inter-connected vessels to lift the marine structure to a desired position and making the marine structure ready for towing.

* * * * *